US006303184B1

(12) United States Patent
Lobo et al.

(10) Patent No.: US 6,303,184 B1
(45) **Date of Patent: *Oct. 16, 2001**

(54) METHOD OF FORMING A DISCONTINUOUS POLYMER OVERCOAT FOR IMAGING ELEMENTS

(75) Inventors: Rukmini B. Lobo, Webster; Barry A. Fitzgerald, Holley; Lloyd A. Lobo, Webster; Mridula Nair, Penfield, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/313,555

(22) Filed: May 14, 1999

(51) Int. Cl.[7] ..... B05D 5/00
(52) U.S. Cl. ..... 427/261; 427/286; 427/288
(58) Field of Search ..... 427/256, 261, 427/286, 288

(56) References Cited

U.S. PATENT DOCUMENTS 2,173,480 9/1939 Jung .
2,259,009 10/1941 Talbot .

(List continued on next page.)

OTHER PUBLICATIONS

M. E. Odiotti and V. Colaprico, "Gravure Process and Technology", Gravure Association of America, 1991.
J. K. Sears and J. R. Darby, "The Technology of Plasticizers", John Wiley & Sons, New York 1982.
*Research Disclosure* No. 34390, Nov. 1992, Photographic Light–Sensitive Silver Halide Film Can Comprise A Transparent Magnetic Recording Layer, Usually Provided On The Backside Of The Photographic Support.
*Research Disclosure* No. 37038, Feb. 1995, Typical And Preferred Colored Paper, Color Negative, And Color Reversal Photographic Elements And Processing.
*Research Disclosure* No. 38957, Sep. 1996, Photographic Silver Halide Emulsions, Preparations, Addenda, Systems and Processing.

*Primary Examiner*—Fred J. Parker
(74) *Attorney, Agent, or Firm*—Chris P. Konkol; Carl F. Ruoff

(57) ABSTRACT

The present invention is a method of providing an imaging element which includes providing a gravure cylinder having an outer surface having a plurality cells. The surface of the cylinder is moved through a coating solution of a film forming organic polymer to fill the cells with coating solution. An imaging element is moved across the outer surface of the gravure cylinder to deposit the coating solution onto the imaging element such that a fraction of the imaging element of from 0.02 to 0.98 remains uncovered with coating solution. The coating solution is dried to form a discontinuous overcoat on the imaging element.

8 Claims, 9 Drawing Sheets

U.S. PATENT DOCUMENTS

| | | | |
|---|---|---|---|
| 2,331,746 | | 10/1943 | Talbot . |
| 2,706,686 | | 4/1955 | Hilborn . |
| 2,798,004 | | 7/1957 | Weigel . |
| 3,113,867 | | 12/1963 | Van Norman et al. . |
| 3,190,197 | | 6/1965 | Pinder . |
| 3,397,980 | | 8/1968 | Stone . |
| 3,415,670 | | 12/1968 | McDonald . |
| 3,443,946 | | 5/1969 | Grabhofer et al. . |
| 3,502,501 | | 3/1970 | Burczyk et al. . |
| 3,508,947 | | 4/1970 | Hughes . |
| 3,697,277 | | 10/1972 | King . |
| 3,733,293 | | 5/1973 | Gallagher et al. . |
| 3,936,549 | | 2/1976 | Kohler et al. . |
| 4,092,173 | | 5/1978 | Novak et al. . |
| 4,158,333 | | 6/1979 | Navi . |
| 4,171,979 | | 10/1979 | Novak et al. . |
| 4,209,584 | * | 6/1980 | Joseph . |
| 4,279,945 | | 7/1981 | Audran et al. . |
| 4,302,523 | | 11/1981 | Audran et al. . |
| 4,333,998 | | 6/1982 | Leszyk . |
| 4,373,443 | | 2/1983 | Matalia et al. . |
| 4,426,431 | | 1/1984 | Harasta et al. . |
| 4,999,266 | | 3/1991 | Platzer . |
| 5,179,147 | | 1/1993 | Jones . |
| 5,368,894 | * | 11/1994 | Lammers et al. . |
| 5,376,434 | | 12/1994 | Ogawa et al. . |
| 5,447,832 | | 9/1995 | Wang et al. . |
| 5,503,876 | * | 4/1996 | Fields et al. . |
| 5,681,381 | | 10/1997 | Auslander et al. . |
| 5,723,273 | * | 3/1998 | Anderson et al. . |
| 5,853,965 | | 12/1998 | Haydock et al. . |
| 5,866,282 | | 2/1999 | Bourdelais et al. . |
| 5,874,205 | | 2/1999 | Bourdelais et al. . |
| 5,888,643 | | 3/1999 | Aylward et al. . |
| 5,888,681 | | 3/1999 | Gula et al. . |
| 5,888,683 | | 3/1999 | Gula et al. . |
| 5,888,714 | | 3/1999 | Bourdelais et al. . |

* cited by examiner

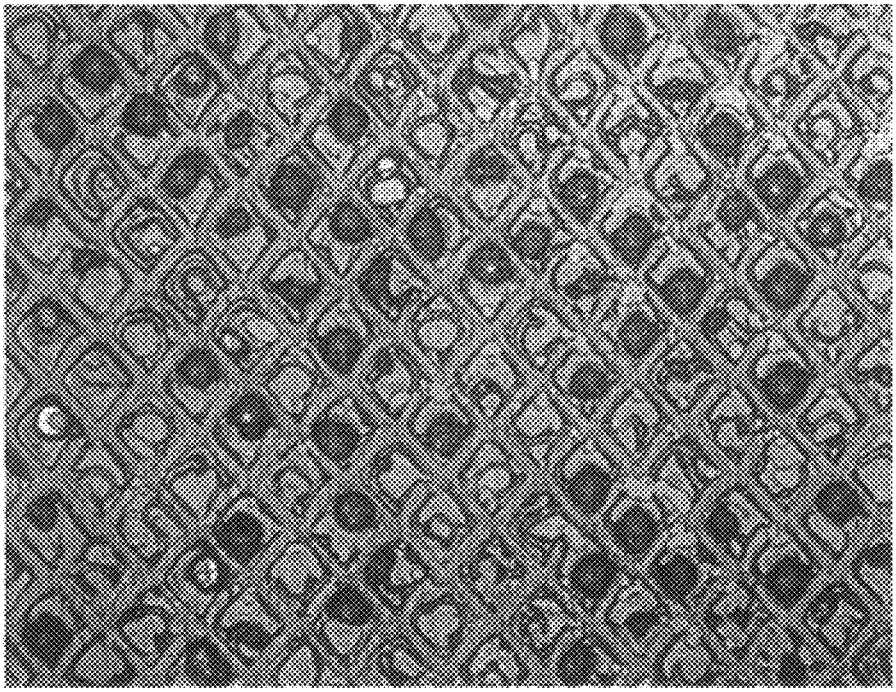
Fig 7. a
.1mm
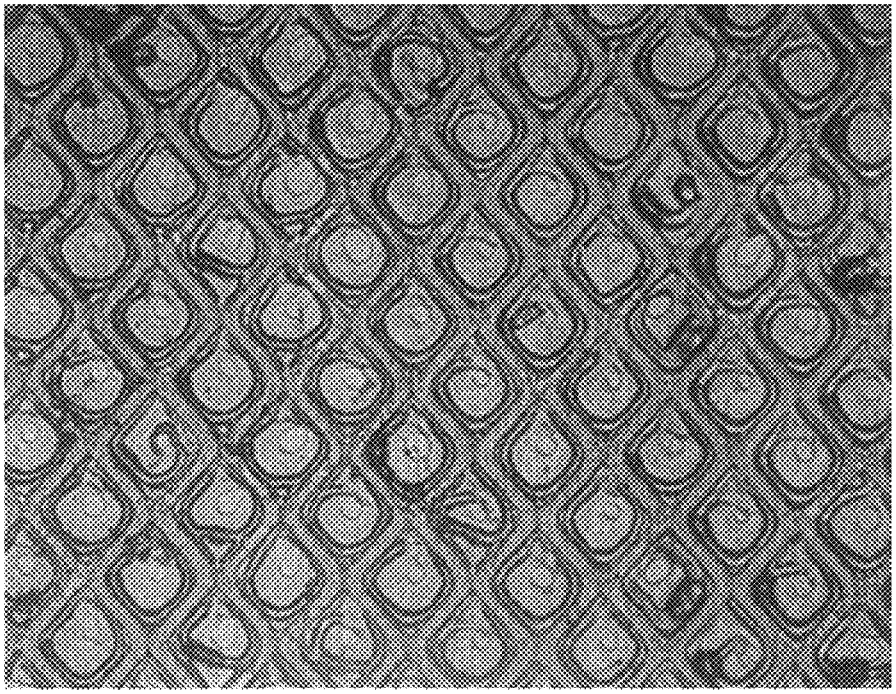
Fig 7. b
.1mm

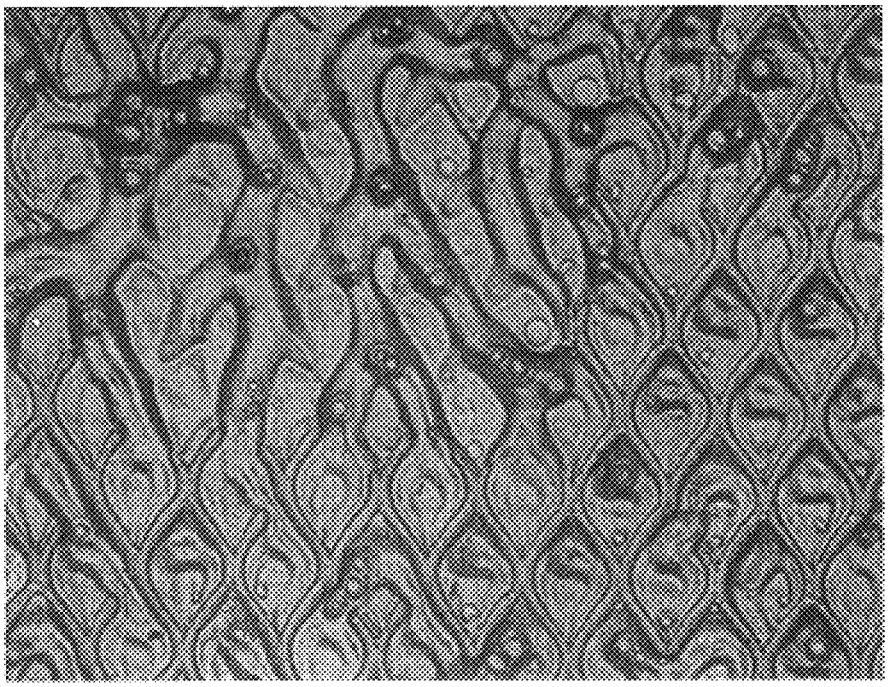
Fig 7. c
.1mm
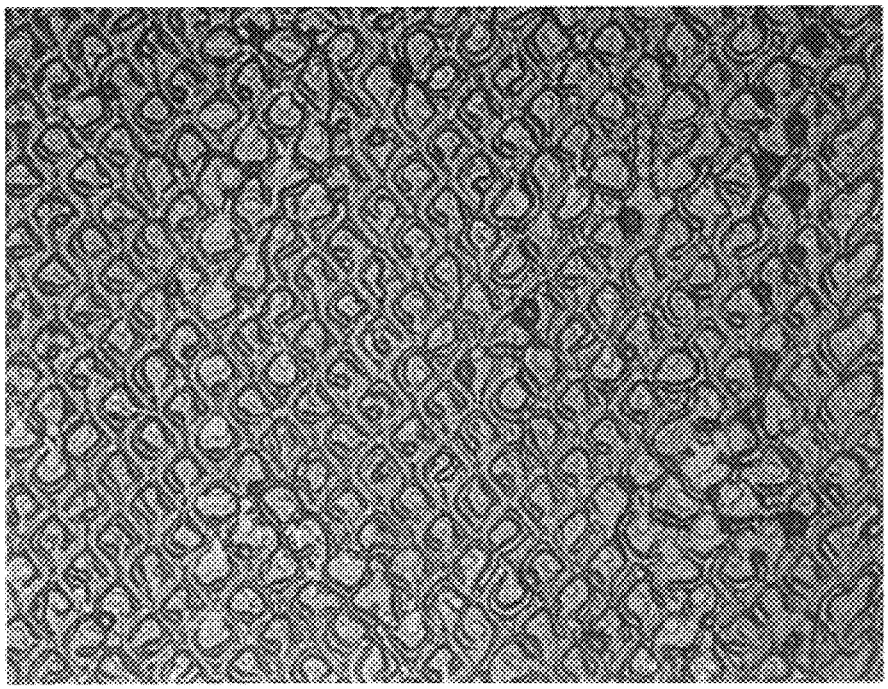
Fig 7. d
.1mm

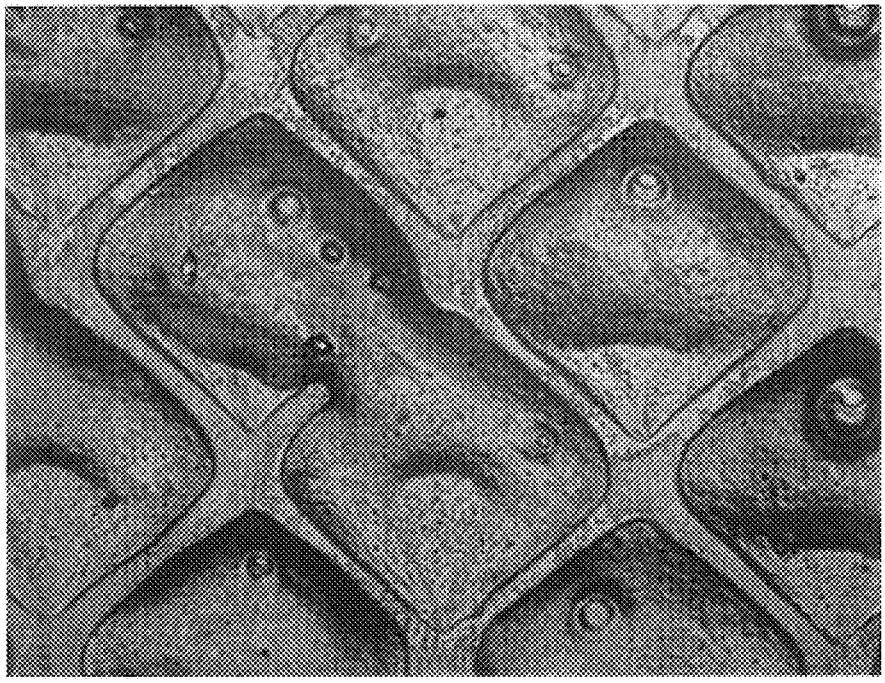
Fig 7. e
.1mm
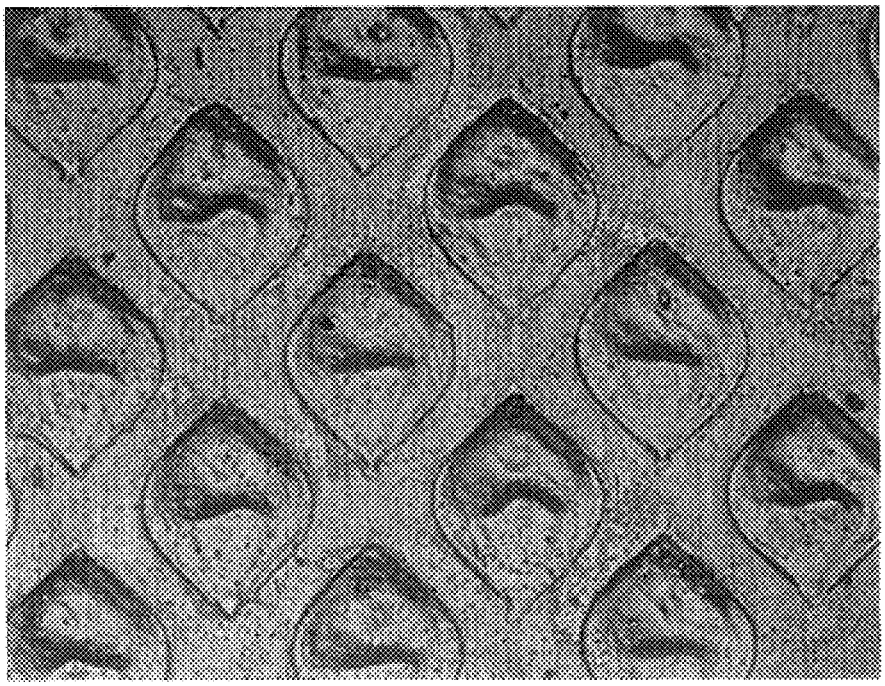
Fig 7. f
.1mm

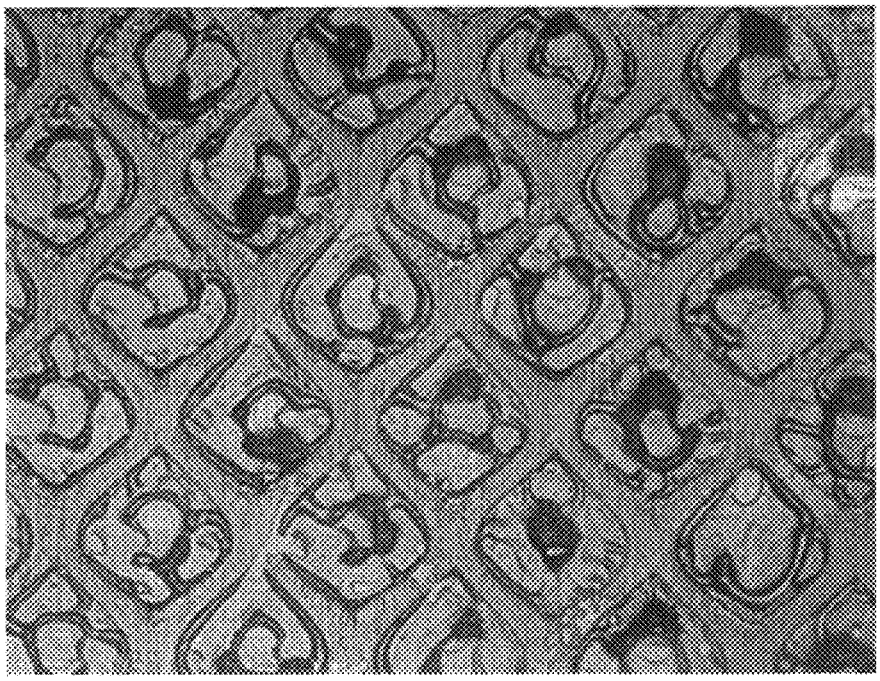
Fig 7. g
.1mm
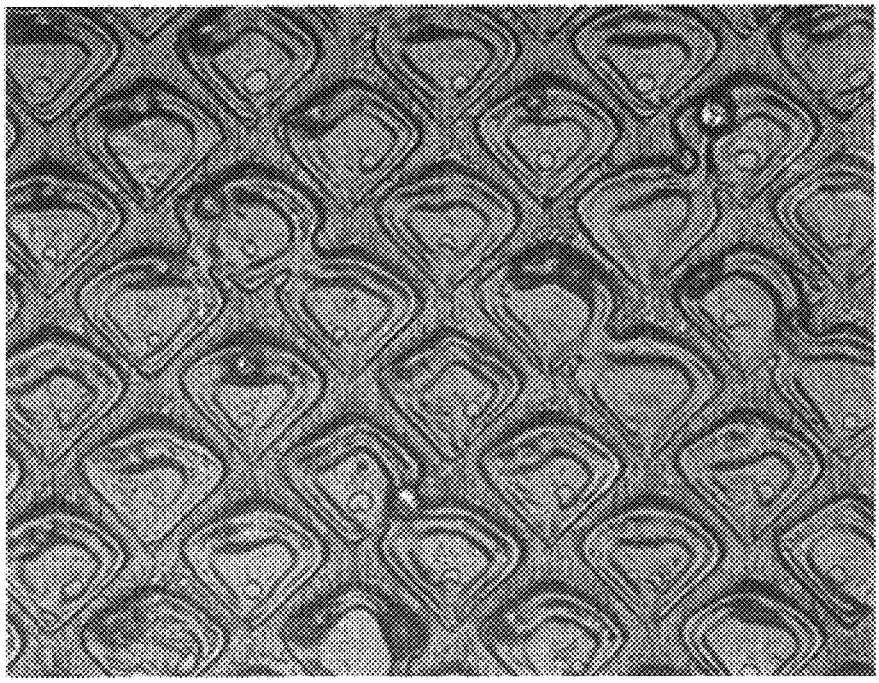
Fig 7. h
.1mm

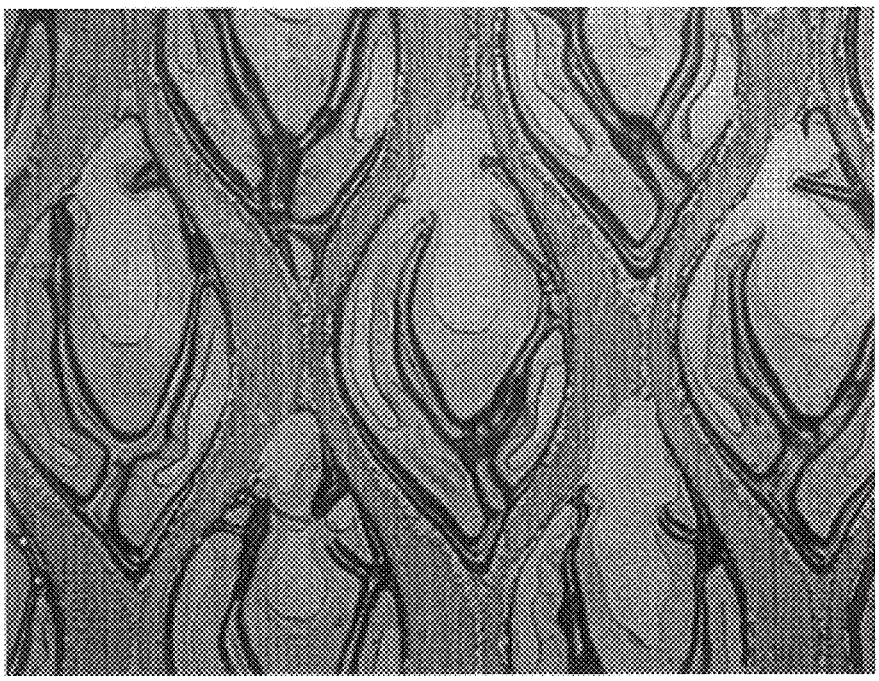
Fig 7. i
.1mm

METHOD OF FORMING A DISCONTINUOUS POLYMER OVERCOAT FOR IMAGING ELEMENTS

CROSS REFERENCE TO RELATED APPLICATIONS

This application relates to commonly assigned copending application Ser. No. 09/311,968, filed simultaneously and incorporated by reference herewith.

FIELD OF THE INVENTION

The present invention relates to a process for providing imaging elements with a discontinuous overcoat. More particularly, the discontinuous overcoat allows processing solution permeation and then the discontinuous overcoat can be fused to form a continuous protective overcoat.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin, and similar natural or synthetic hydrophilic polymers, have proven to be the binders of choice for silver halide photographic elements. Unfortunately, when gelatin, and similar polymers, are formulated so as to facilitate contact between the silver halide crystal and aqueous processing solutions, they are not as tough and mar-resistant as would be desired for something that is handled in the way that an imaged photographic element may be handled. Thus, the imaged element can be easily marked by fingerprints, it can be scratched or torn and it can swell or otherwise deform when it is contacted with liquids.

There have been attempts over the years to provide protective layers for gelatin based photographic systems that will protect the images from damages by water or aqueous solutions. Copending application U.S. Ser. No. 09/311,968 describes a photographic element having a discontinuous overcoat, comprising a polymer. The discontinuous overcoat has a certain percentage of the area (from 2 to 98%) covered by the polymer. The area not covered by the polymer allows the processing solutions to pass into and out of the photographic element. Thus, it allows an image to be formed, and the fixed silver to be removed from the film. The photographic element after imaging and processing can then be treated in some manner so as to make the discontinuous polymer overcoat flow and become continuous, thereby reducing the permeability of the imaged element to aqueous solutions.

U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009; 2,331,746; 2,798,004; 3,113,867; 3,190,197; 3,415,670 and 3,733,293. The application of UV-polymerizable monomers and oligomers on processed image followed by radiation exposure to form crosslinked protective layer is described U.S. Pat. Nos. 4,092,173; 4,171,979; 4,333,998 and 4,426,431. One drawback for the solvent coating method and the radiation cure method is the health and environmental concern of those chemicals to the coating operator. The other drawback, is that these materials need to coated after the processing step. Thus, the processing equipment needs to be modified as well as the personnel running the processing operation needs to be trained. In addition, several lamination techniques are known and practiced in the trade. U.S. Pat. Nos. 3,397,980; 3,697,277 and 4,999,266 describe methods of laminating polymeric sheet film on the processed image as the protective layer. U.S. Pat. No. 5,447,832 describes the use of a protective layer containing mixture of high and low Tg lattices as the water-resistance layer to preserve the antistat property of the $V_2O_5$ layer through photographic processing. This protective layer is not applicable to the image formation layers since it will detrimentally inhibit the photographic processing. U.S. Pat. No. 5,376,434 describes a method to apply a water resistant polymeric overcoat by coating an aqueous solution containing polymer latices, after the imaging element has been imaged and subjected to photo processing. U.S. Pat. No. 2,706,686 describes the formation of a lacquer finish for photographic emulsions, with the aim of providing water- and fingerprint-resistance by coating the emulsion, prior to exposure, with a porous layer that has a high degree of water perm ability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. U.S. Pat. No. 3,443,946 provides a roughened (matte) scratch-protective layer, but not a water-impermeable one. U.S. Pat. No. 3,502,501 provides protection against mechanical damage only; the layer in question contains a majority of hydrophilic polymeric materials, and must be permeable to water in order to maintain processability. U.S. Pat. No. 5,179,147 likewise provides a layer that is not water-protective. However, all these techniques need to be carried out after the image has been formed, which adds a large cost to final imaged product.

Thus, the ability to provide the desired property of post-process water/stain resistance of the imaged element, at the point of manufacture of the imaging element, is a highly desired feature. However, in order to accomplish this feature, the desired imaging element should be permeable to aqueous solutions during the processing step, but achieve water impermeability after processing, without having to apply additional chemicals or to substantially change the chemicals used in the processing operation.

Therefore there remains a need for a water-resistant protective overcoat that can be incorporated into an imaging element, which at the same time allows for uninhibited diffusion of photographic processing solutions, and which can then be made impermeable to aqueous solutions after exposure and processing. This invention pertains to a method for forming such a discontinuous overcoat.

SUMMARY OF THE INVENTION

The present invention is a method of providing an imaging element which includes providing a gravure cylinder having an outer surface having a plurality cells. The surface of the cylinder is moved through a coating solution of a film forming organic polymer to fill the cells with coating solution. An imaging element is moved across the outer surface of the gravure cylinder to deposit the coating solution onto the imaging element such that a fraction of the imaging element of from 0.02 to 0.98 remains uncovered with coating solution. The coating solution is dried to form a discontinuous overcoat on the imaging element.

BRIEF DESCRIPTION OF THE DRAWINGS

FIGS. 7 (*a*)–(*i*) shows digital images of the coatings applied from the engraving cylinders of FIG. 6.

Figure 1:
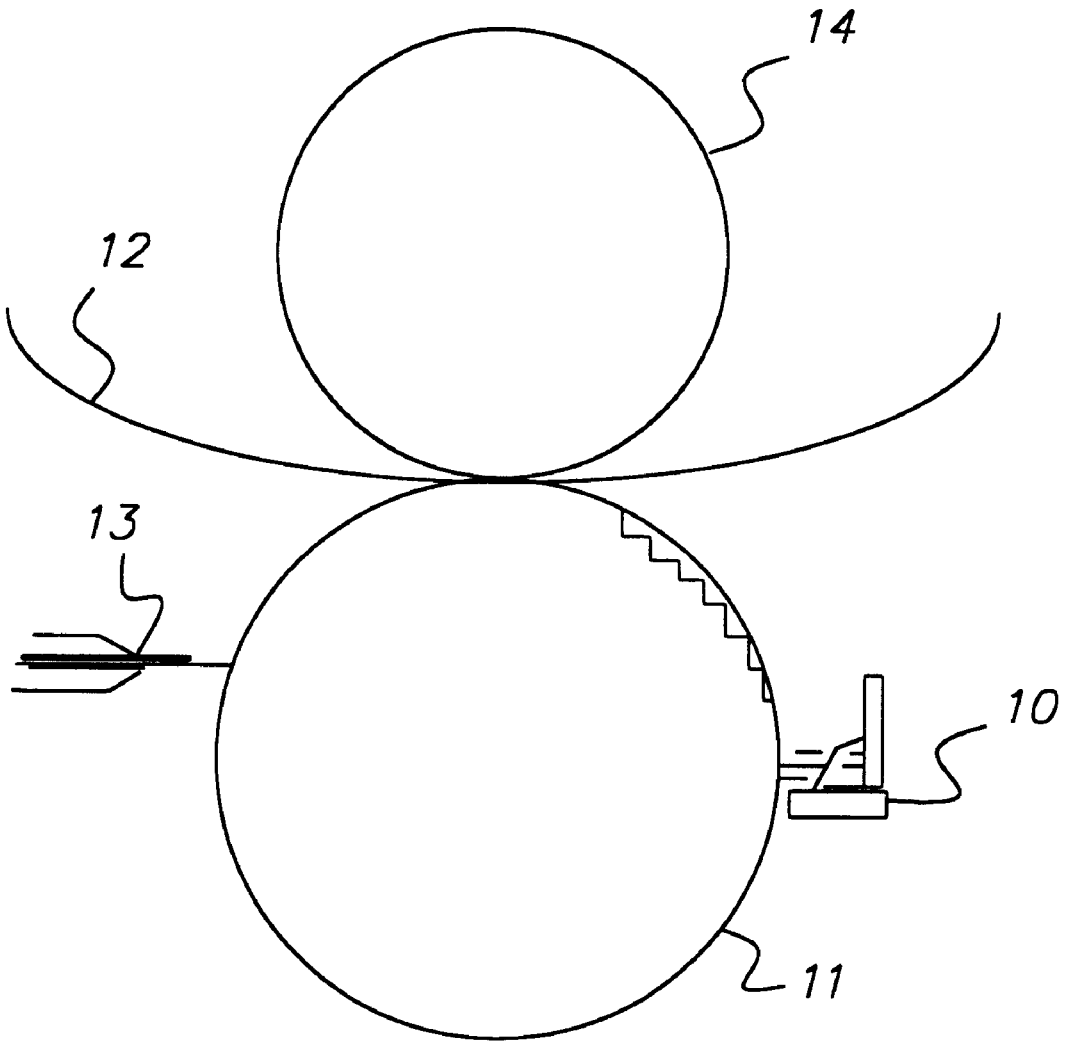
FIG. 1 shows a direct gravure coating operation.

For a better understanding of the present invention, together with other advantages and capabilities thereof, reference is made to the following detailed description and claims in connection with the above described drawings.

DETAILED DESCRIPTION OF THE INVENTION

The aim of this invention is to provide a method to form a discontinuous polymer overcoat on an imaging element, more particularly to the emulsion side of imaging elements, specifically photographic paper. The discontinuous polymer overcoat of the invention enables exposure and processing, and can be made into a continuous overcoat which is a water-impermeable protective layer in a post-process coalescing step. The overcoat is formed by coating in a discontinuous manner an aqueous solution or suspension of a water dispersible or soluble polymer, a volatile solvent solution of polymer or a polymer melt on the emulsion side of a sensitized photographic product. After exposure and processing, the product with image is treated in such a way as to cause coalescence of the discontinuously coated polymer, by heat and/or pressure (fusing), solvent treatment, or other means so as to form the desired continuous, water impermeable protective layer.

The support material used with this invention can comprise various polymeric films and papers. The thickness of the support is not critical. Support thicknesses of 2 to 15 mils (0.002 to 0.015 inches) can be used. Biaxially oriented support laminates can be used with the present invention. These supports are disclosed in U.S. Pat. Nos. 5,853,965, 5,866,282, 5,874,205, 5,888,643, 5,888,681, 5,888,683, and 5,888,714, incorporated by reference herein. These supports include a paper base and a biaxially oriented polyolefin sheet, typically polypropylene, laminated to one or both sides of the paper base. A least one photosensitive silver halide layer is applied to the biaxially oriented polyolefin sheet.

The preferred method of coating the discontinuous polymer overcoat is by gravure. The method can provide continuous high speed coating operations to obtain the discontinuous overcoat. Multilayered photographic elements are usually coated on high speed coating machines as described in U.S. Pat. No. 3,508,947. The web or support is usually transported at speeds of up to 1500 ft/min. Depending on the number of layers to be coated on to the web, these coating machines can have several coating stations in tandem, where the certain number of fluid layers is deposited at one station, the web is then dried and the next set of fluid layers is deposited at the next station. In order for the element having a discontinuous overcoat to be manufactured at a low cost, it is highly desirable that the overcoat be applied at the same time as the rest of the photographic element is coated. Thus, the coating method of choice should be able to run at the same speed as the rest of the coating operation. Since, gravure coating technology is capable of coating at high speeds, it is the most preferred method for forming the discontinuous overcoat.

The principle of a gravure coating operation is shown in FIG. 1. A coating solution is filled into a feed pan 10. The gravure coating method utilizes an engraved gravure cylinder 11 to apply a coating composition on to a web 12. The engraving or cells on the gravure cylinder 11, which retains the coating composition, is typically filled by immersion of the roll into the feed pan. Excess liquid is scraped off the surface of the gravure cylinder by means of a doctor blade 13, so that the cylinder delivers a precise amount of liquid from the cells to the web upon contact. The contact between the web and the gravure cylinder is aided by an impression roller 14, whose pressure and hardness can alter the nip footprint and hence transfer characteristics of the liquid from the cells to the web. A description of the gravure operation for delivering ink to newspapers is described in U.S. Pat. No. 4,373,443. Several variations of this basic gravure coating operations are possible. Various methods of feeding the coating solution to wet the cells in the etched cylinder are described in U.S. Pat. Nos. 3,936,549; 4,158,333; 5,681,381 etc. The pattern maybe etched by various methods known in the art, such as chemical etching, electromechanical, electronic, laser or electron beam. Different types of geometrical patterns can be etched or engraved on the gravure cylinder.

While the ultimate pattern is dependent on the etched or engraved pattern on the cylinder, process parameters that are used to affect the quality of the pattern include method of contacting the coating solution and the gravure cylinder, position and angle of the doctor blade, impression cylinder pressure and coating speed. In the present invention it is preferred that the coating solution does not flow after coating on the imaging element. Therefore the dimensional requirements for the discontinuous overcoat also apply to engraved gravure cylinder.

A suitable method of feeding the gravure cylinder maybe selected dependent on the fluid properties and the desired coating speed. The simplest device used is a pan feed, but is found to be limited at higher speeds, due to unmetered layers and recirculation flows. While a simple feedbar maybe be sufficient in feeding a uniform metered film to the cylinder, a pressurized doctor feed system maybe used for higher speeds and foam sensitive material. A free falling curtain as described in U.S. Pat. No. 5,681,381 may be used at high speed to provide hydrodynamic assist and hence delay air entrainment.

While the preferred doctor blade 13 may be above a 9 o'clock position on the engraved cylinder, in cases when a pressurized doctor feed system is used the position may be at 3 to 5 o'clock. In the latter case, a reverse angle blade maybe used. In the former case a blade contact angle between 50 and 65 degrees is preferred, to achieve a distinct doctoring.

The impression roller 14 used in the process has a flexible covering, made of a suitable material, and whose hardness may vary between 40 and 90 durometer. The pressure applied by air loading or mechanical stops, controls the transfer characteristics, of the fluid on to the web. Additionally, an electrostatic assist charge on the backer roller can be used to alter the transfer of the fluid as described in "Gravure Process and Technology", Gravure Association of America, Rochester, N.Y., 1991.

The geometrical pattern with which the pattern is deposited on the photographic element depends on the engraved geometry as well as the amount of flow during and after the coating is made. The discontinuous coating will be laid down in a pattern, which constitutes a spatial repetition of a basic element of coated patches. There are three fundamental patterns by which discontinuous coating can be made. 1) As discrete islands of polymer deposited on the top of the imaging element, 2) where the discrete islands are the areas that are uncoated and 3) a bicontinuous pattern where both the uncoated and coated areas are continuous within themselves. Descriptions of these types are given in copending application U.S. Ser. No. 09/311,968. FIGS. 2–5 show these patterns The geometry of this pattern, i.e., the shape, size and spatial frequency will affect the following factors 1) The quality of the image, 2) The rates of the various steps in the processing chemistry and 3) the ability to fuse and form a continuous overcoat.

Figure 2:
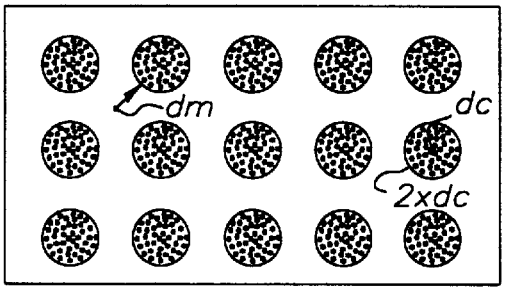
FIG. 2 shows one pattern for a discontinuous overcoat of the present invention.
Figure 3:
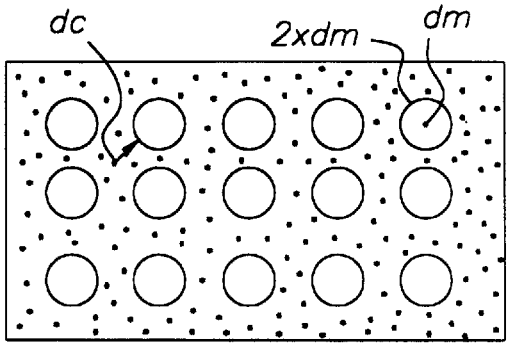
FIG. 3 shows an alternate pattern for a discontinuous overcoat of the present invention.
Figure 4:
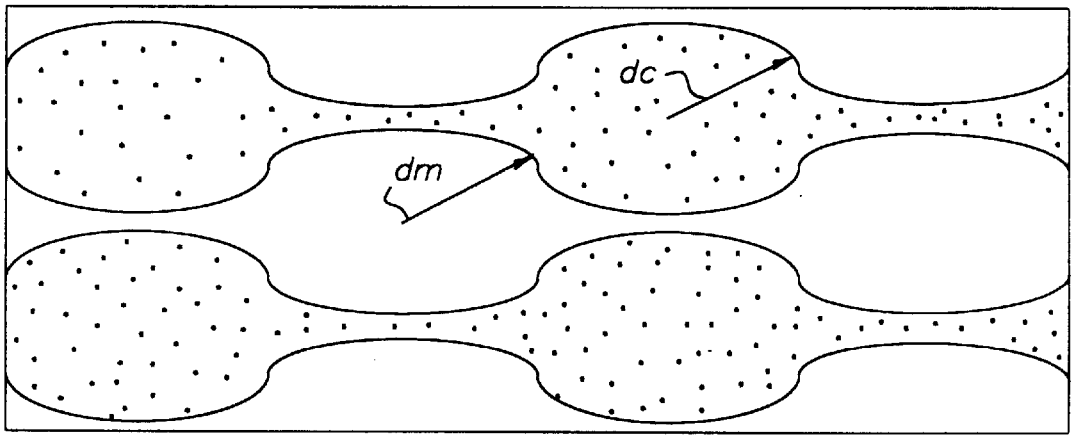
FIG. 4 shows an alternate pattern for a discontinuous overcoat of the present invention.
Figure 5:
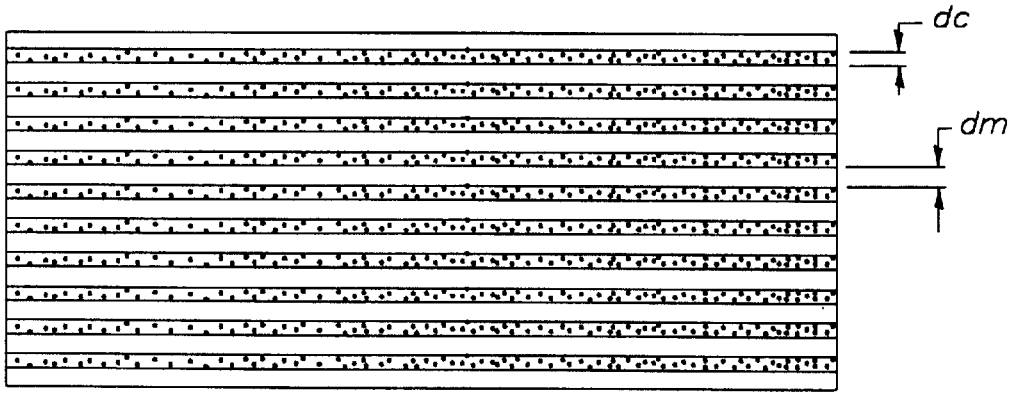
FIG. 5 shows a trihelical pattern for a discontinuous overcoat of the present invention.
Figure 6A:
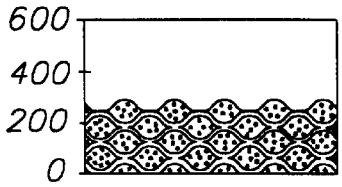
FIGS. 6 (*a*)–(*i*) show the geometrical pattern shapes of a series of engravings on various engraving cylinders.
Figure 6B:
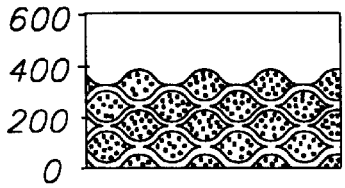
Figure 6C:
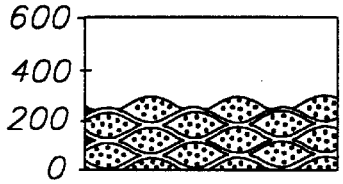
Figure 6D:
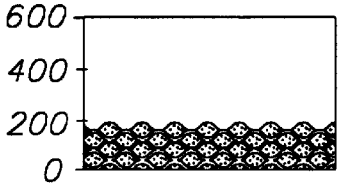
Figure 6E:
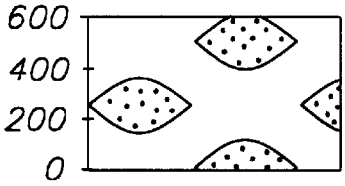
Figure 6F:
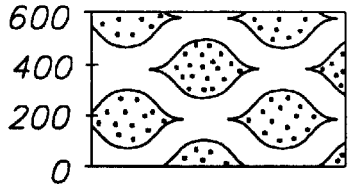
Figure 6G:
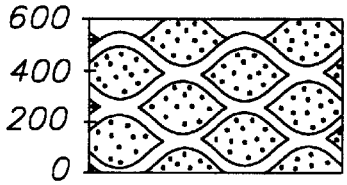
Figure 6H:
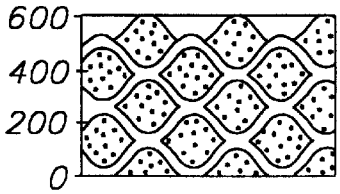
Figure 6I:
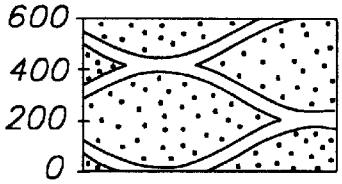

Some of the fundamental geometrical patterns that can exist in a discontinuous overcoat are shown in FIGS. 2–5. FIG. 2 shows where the polymer is laid down as discrete patches and resemble islands within the surface of the imaging elements. FIG. 3 shows where the islands are uncoated areas and the rest of the area is covered by the polymer. FIG. 4 show a pattern in which neither the coated nor the uncoated areas are present as discrete patches but each forms a continuous domain. The two continuous area domains coexist, hence this is called bicontinuous. FIG. 5 shows a pattern in which the polymer is laid down parallel stripes, another example of a bicontinuous pattern. The common property of these geometries is that the surface of the imaging element that is furthest away from the support, is partially covered by a polymer. The percent area of the surface that is covered by the polymer can vary anywhere from 2 to 98%.

There are certain functional requirements of the parameters of the geometrical patterns that are described as follows:

1) In order to ensure that the polymer can flow into the uncovered areas and coalesce during the fusing step, within an uncovered area, the longest distance (dm) between any point in the uncovered area and the nearest edge of the covered area should not be greater than 500 $\mu$m.

2) In order for the chemical reactions during the processing, step to take place uniformly over the entire imaging element, the diffusion time, of chemicals in the underlying swollen gelatin matrix, from the edge of a covered area to its center, should be as short as possible. Within a covered area the longest distance between any point in the covered area and the nearest edge of the uncovered area is defined as dc. Based, on measured diffusion coefficients of developers in a swollen gelatin matrix, it is estimated that the limiting distance dc should not be greater than 100 $\mu$m. However, if the processing solutions have some degree of permeability through the patch, this dimension can be significantly larger and as much as 1 mm.

The graphical representations of the distances dm and dc for each type of geometrical pattern is shown in FIGS. 2–5.

When the discontinuous coating is made of patches as shown in FIG. 2 it is preferred that the spatial frequency be greater than 1000 patches/in$^2$.

The thickness of the polymer patch should be less than 500 $\mu$m, so that the optical properties of the surface of the imaging element is not altered substantially. The ratio of the covered to uncovered, Ar, is limited by the area required to swell and transport processing chemicals into and out of the imaging element. Thus Ar can vary from 1:49 to 49:1, depending on the permeability of the polymer coating under processing conditions. The total coverage of the polymer (based on the total area), Pc, is determined by the needs of the post coalesced coatings. In order that the continuous overcoat, derived from coalescing the discontinuous overcoat, be sufficiently impermeable as well as durable the mean polymer laydown should be at least 0.11 g/m$^2$ over the entire surface area of the imaging element and in order to maintain the image quality, no more the 5.38 g/m$^2$.

The volume of fluid/unit area, that is to be deposited in the covered areas (Vc) in general is given by $$Vc = \frac{Pc\left(1 + \frac{1}{Ar}\right)}{Cp}$$

In the case of the geometric scheme (FIG. 2), where the polymer is laid down as discrete islands or patches, it is useful to know the volume required per patch. The volume per patch Vp (in ml) is given by $$Vp = \frac{Pc}{PI\ Cp}$$

Where Cp is the concentration of the polymer in the coating melt in mg/ml and PI is the number of patches per unit area.

The distance between patches should be such that post process coalescence is possible, and therefore, not greater than 1 mm.

One method of engraving the gravure cylinder to obtain a geometrical pattern of discrete polymer patches is to use a diamond shaped engraving stylus. The stylus is plunged into and out of the surface of the gravure cylinder to create a series of cells at a given spatial frequency. The dimensions of each engraved cell is determined by the shape of the stylus and the distance separating the cells is determined by the spatial frequency.

Geometrical patterns where the uncoated areas are discrete are obtained from similar patterns as described above. In this case the shortest distance between edges of adjacent cells are smaller than 10 $\mu$m. Upon coating the solution flows between these edges, thus making the polymer continuous.

One way of obtaining a striped pattern of the polymer on the surface of the photographic element as shown in FIG. 5, is by use of a gravure cylinder engraved with a tri-helical geometry. An engraving tool is used to deform the surface of the gravure cylinder forming grooves that run around the circumference of the cylinder with a constant screw angle to form the helix. The actual pattern is composed of three helices with a constant phase angle between the helices. The tool angle, which is related to the shape of the engraving tool, determines the shape of the groove and the volume of the fluid that the engraving carries. After the engraving has been carried out the surface of the gravure cylinder may be ground down. Surface grinding accomplishes the following—1) it increases the land area on gravure cylinder and 2) it decreases the volume of the engraved section. Upon coating it effectively translates to increased spacing between the edges of adjacent polymer stripes. Thus, by choosing the appropriate stylus angle, depth of engraving, pitch of the helix (or lines per inch) and amount of post-engraving grinding, it is possible to achieved the exact geometry and coated volume for the striped pattern. The actual pattern that results from a trihelical geometry is one of parallel stripes, since each of the helices run parallel to each other. The dimensions of the printed pattern depends on the rheology of the fluid to be coated, as mentioned below.

The fluid properties of the coating solution affect the quality of the transfer of the pattern. In order that the geometry of the discontinuous polymer coating to be the same as the engraving on the cylinder, the viscosity of the solution should be high enough that upon deposition of the fluid, it does not flow substantially. Thus, the viscosity of the solution at shear rate less than 1 $s^{-1}$ should be greater than 200 cp. Also, at the point of contact between the engraved gravure cylinder and the web (the nip), there is a high shear rate in the fluid being transferred. The viscosity at this shear rate should be sufficiently high such that the fluid elements in any part of the pattern do not flow and join the fluid element of another part of the pattern. If this happens the phenomenon is commonly called "ribbing". In order to avoid the phenomenon of ribbing, the viscosity of the coating solution at a shear rate greater than 1000 $s^{-1}$ should be greater than 50 cp. In the case where a bicontinuous type of overcoat is desired, a ribbed type of pattern can be obtained by maintaining a low viscosity at the high shear rates.

In order to achieve the desired rheology of the coating solutions containing the polymer, thickening agents, well known in the trade can be employed. For aqueous coating solutions, water soluble polymers are commonly used as thickening agents. Examples of thickening agents are cellulosic materials such as carboxymethylcellulose, natural or synthetic polysaccharides such as xanthan gum, guar gum, locust bean gum, carageenan, konjac mannan, etc. Other water soluble thickeners include gelatin, polyvinyl pyrollidone, polyacrylamide, polyvinyl alcohol, polystyrene sulfonate and other water soluble polymers. If the coating solvent is a volatile organic solvent, suitable viscosifiers include organic soluble polymers such as poly methylmethacrylate, polydimethylsiloxane, cellulose acetate propionate.

The fluid should also fill the etched cylinder, uniformly. Additionally, the web should be easily wet by the fluid otherwise the individual fluid elements will bead up. This can be accomplished by addition of appropriate surfactants at the appropriate concentrations. Examples of surfactants that can be used for aqueous systems are sodium diisopropylnaphthalene sulfonate, sodium dodecylbenzene sulfonate, TX200, OLIN10G etc. Examples of surfactants that can be used for organic solvent coatings can be FC430, DC510, FC170 etc.

Examples of polymer solutions/dispersions used in this invention are derived can be selected from, for example, polymers of alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, butadiene, chlorinated propylene and copolymers therof. Suitable polymers containing carboxylic acid groups include polymers derived from acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrenecarboxylic acid. Other polymers include ethyl cellulose, nitrocellulose, linseed oil-modified alkyd resins, rosin-modified alkyd resins, phenol-modified alkyd resins, phenolic resins, polyesters, poly(vinyl butyral), polyisocyanate resins, polyurethanes, polyamides, chroman resins, dammar gum, ketone resins, maleic acid resins, poly(tetrafluoroethylene-hexafluoropropylene), low-molecular weight polyethylene, phenol-modified pentaerythritol esters, copolymers with siloxanes and polyalkenes. These polymers can be used either alone or in combination. The polymers may be crosslinked or branched.

In order to enable post-process melt flow and coalescence during the fusing step, in a particular embodiment the coating composition is composed of a mixture of high (B) and low (A) Tg polymers. The low Tg polymer A, having a Tg less than 30° C., is present in the patches in an amount of from 5 to 70 percent by weight and preferably from 10 to 50 percent by weight based on the total weight of the discontinuous layer. An aqueous coating formulation of 3% by weight of the colloidal polymer free of organic solvent or coalescing aid, is applied to a subbed sheet of polyethylene terephthalate in a wet coverage of 10 ml/$m^2$ and dried for 30 minutes at 30° C. Polymers that form clear, transparent continuous films under these conditions are low Tg and film-forming, while those that do not form clear, transparent continuous films are high Tg and non-film-forming at room temperature, for the purpose of this invention.

The high Tg polymer (B), having a Tg greater than 30° C. comprises glassy polymers that provide resistance to blocking, ferrotyping, abrasion and scratches. High Tg polymer B is present in the coating composition and in the overcoat layer in an amount of from 30 to 80 and preferably from 50 to 70 percent based on the total weight of low Tg polymer (A) and high Tg polymer (B). These polymers include addition-type polymers and interpolymers prepared from ethylenically unsaturated monomers such as acrylates including acrylic acid, methacrylates including methacrylic acid, acrylamides and methacrylamides, itaconic acid and its half esters and diesters, styrenes including substituted styrenes, acrylonitrile and methacrylonitrile, vinyl acetates, vinyl ethers, vinyl and vinylidene halides, and olefins. In addition, crosslinking and graft-linking monomers such as 1,4-butyleneglycol methacrylate, trimethylolpropane triacrylate, allyl methacrylate, diallyl phthalate, divinyl benzene, and the like may be used. Other polymers that may comprise component B include water-dispersible condensation polymers such as polyesters, polyurethanes, polyamides, and epoxies. Polymers suitable for component B do not give transparent, continuous films upon drying at temperatures below 30° C. when the above-described test is applied.

The low Tg polymer (A) comprises polymers that form a continuous film under the extremely fast drying conditions typical of the photographic film manufacturing process. Polymers that are suitable for component A are those that give transparent, continuous films when the above-described test is applied and include addition-type polymers and interpolymers prepared from ethylenically unsaturated monomers such as acrylates including acrylic acid, methacrylates including methacrylic acid, acrylamides and methacrylamides, itaconic acid and its half esters and diesters, styrenes including substituted styrenes, acrylonitrile and methacrylonitrile, vinyl acetates, vinyl ethers, vinyl and vinylidene halides, and olefins. In addition, crosslinking and graft-linking monomers such as 1,4-butyleneglycol methacrylate, trimethylolpropane triacrylate, allyl methacrylate, diallyl phthalate, divinyl benzene, and the like may be used. Other suitable polymers useful as component A are low Tg dispersions of polyurethanes or polyesterionomers.

In order to increase the permeability of the discontinuous overcoat and also to extend the size of each polymer patch in accordance with equation 1, a preferred polymeric material is one that would allow some degree of permeability through the patch itself. One such preferred polymer is a hybrid urethane-vinyl copolymer having an acid number of greater than or equal to 5 and less than or equal to 30. Acid number is in general determined by titration and is defined as the number of milligrams of potassium hydroxide (KOH) required to neutralize 1 gram of the polymer as described in U.S. Ser. No. 09/235,436. Polyurethanes provide advantageous properties such as good film-formation, good chemical resistance, abrasion-resistance, toughness, elasticity and durability. Further, polyester based urethanes exhibit high levels of tensile and flexural strength, good abrasion resistance and resistance to various oils. Acrylics have the added advantage of good adhesion, non-yellowing, adjustable for high gloss and a wide range of glass transition (Tg) and minimum film forming temperatures. The urethane vinyl hybrid polymers are very different from blends of the two. Polymerization of the vinyl monomer in the presence of the polyurethane causes the two polymers to reside in the same latex particle as an interpenetrating or semi-interpenetrating network resulting in improved resistance to water, organic solvents and environmental conditions, improved tensile strength and modulus of elasticity. The presence of acid groups such as carboxylic acid groups provide a conduit for processing solutions to permeate the patches at high pH. Maintaining the acid number greater than 30 ensures that the overcoat has good adhesion to the substrate below even at high pH and makes the overcoat more water resistant. The overcoat layer formed after coalescing the patches in accordance with this invention is particularly advantageous due to superior physical properties including excellent resistance to water, fingerprinting, fading and yellowing, exceptional transparency and toughness necessary for providing resistance to scratches, abrasion, blocking, and ferrotyping.

The discontinuous polymer coating should be clear, i.e., transparent, and preferably colorless. But it is specifically contemplated that the coated areas can have some color for the purposes of color correction, or for special effects, so long as the image is viewable through the overcoat. Thus, there can be incorporated into the polymer dye which will impart color. In addition, additives can be incorporated into the coating formulation which will give to the overcoat desired properties. For example, a UV absorber can be incorporated into the polymer particle to make the overcoat UV absorptive, thus protecting the image from UV induced fading. Other additional compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of coating aids include any soluble polymer or other material that imparts appreciable viscosity to the coating suspension at rest and shear thinning otherwise, such as high MW polysaccharide derivatives (e.g. xanthan gum, guar gum, gum acacia, KELTROL (an anionic polysaccharide supplied by Merck and Co., Inc.) high MW polyvinyl alcohol, carboxymethylcellulose, hydroxyethylcellulose, polyacrylic acid and its salts, polyacrylamide, etc). Surfactants include any surface active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (AEROSOL OT), and alkylcarboxylate salts such as sodium decanoate.

The step of transforming the discontinuous overcoat into the continuous one is termed as a "fusing" step. In one embodiment, the reduced aqueous permeability afforded by the discontinuous overcoat would not require a fusing step. In other embodiments where a total or partial fusing is desirable, the fusing step can be carried out by several means. In a usual photoprocessing operation, the final step includes drying the imaged element in a dryer at elevated temperature. Depending on the Tg of the polymer and its melt viscosity characteristics, the temperature in the dryer can be adjusted such that fusing occurs. Another method of fusing during the photoprocessing step is to add a coalescing aid at one step within the photoprocessing operation. Typically, the coalescing aid will be added to the last wet operation, i.e., the wash step. Examples of coalescing aids that can be added to the wash water are aqueous soluble glycol ethers such as DOWANOL. If the fusing step is desired to be separate from the photoprocessing step, it can be accomplished chemically as described or in a combination of a heat and pressure application step. A belt or roller fuser device may be used to apply heat and pressure to the imaged element. However, at normal humidity levels at which this fusing operation would be carried out, the Tg of the underlying gelatin matrix would be lower or close to that of the polymer itself. In this case the problem that is encountered in the fusing step is that the discrete areas coated with the polymer sink into the gelatin matrix rather than deform laterally. Thus, depending on the properties of the polymer and the moisture content of the gelatin, (although some amount of lateral diffusion is present,) the deformation of the underlying gelatin matrix may prevent complete fusion of the overcoat. In this instance a specific geometrical pattern that would distribute the pressure and minimize the deformation of the gelatin, would enable the overcoat to fuse. The special case of a parallel striped pattern would be preferred to aid fusing. The striped pattern is expected to distribute the applied fusing pressure evenly. In addition, the distance of polymer flow is uniform throughout the whole pattern.

The surface characteristics of the overcoat are in large part dependent upon the physical characteristics of the polymers which form the continuous phase and the presence or absence of solid, nonfusible particles. However, the surface characteristics of the overcoat also can be modified by the conditions under which the surface is fused. For example, in contact fusing the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

In addition to the polymers which form the overcoat there can be combined with the polymer composition other additives which will modify the surface characteristics of the element. Such additives include lubricants, surfactants (including fluorinated surfactants), dispersing aids, coating aids, thickeners, crosslinking agents or hardeners, soluble and/or solid particle dyes, antifoggants, matte particles, inorganic particles, like silica, and others.

Additionally, in order to aid the fusing step, during which the discontinuous polymer overcoat is made continuous, it is sometime, required that the viscosity of the polymer melt, at the fusion temperatures, be lowered in order to improve the melt flow and coalescence of the patches. One way of accomplishing this is to add plasticizers. A plasticizer is a substance or material incorporated in the polymer melt to increase its flexibility, workability or extensibility. A plasticizer usually reduces the melt viscosity, lowers the temperature of a second order transition or lowers the elastic modulus of the polymer. Examples of useful plasticizers are esters of phthalic acid, phosphoric acid, aliphatic diacids or liquid polymers or oligomers with a relatively low glass transition temperature and include phthalates, adipates, trimellitates, benzoic acid esters, azelates, isobutyrates, glutarate esters, citrate esters, petroleum oils, mineral oils, and phosphate esters. Additional plasticizers can be selected from those described by Sears, J. K. and Darby, J. R. in The Technology of Plasticizers (John Wiley & Sons, NY 1982). More specific examples of plasticizers include di-2-ethylhexyl terephthalate, di-2-ethylhexyl phthalate (DOP), dibutyl phthalate (DBP), ditridecylphthalate (DTP), dioctyl terephthalate, butyl benzyl phthalate (BBP), dipropylene glycol dibenzoate, di-n-butyl azelate, di-n-hexyl azelate, di-2-ethylhexyl azelate, 2,2,4-trimethyl-1,3-pentanediol, diisodecyl glutarate, triethyl citrate, triaryl phosphate ester, tricresyl phosphate (TCP), diocty adipate (DOA), alkyl diaryl phosphates, glycol ethers such as Texanol and Dowanol and many others known to a person of ordinary skill in the art. The amount of plasticizer required depends on the properties of the polymer, such as Tg and molecular weight, and its chemical identity. Levels of plasticizer up to 50% of the total polymer present may be used. Careful choice of the type and amount of plasticizer is critical because excessive amounts of plasticizer will degrade the desired mechanical properties of the overcoat. In the case of aqueous latex suspensions used in this invention, the plasticizers can be added directly to the suspension and it can be loaded into the latex particles by simple mixing. In the case of polymer melts the plasticizer can be added directly to the melt. Alternately, the plasticizer can be incorporated during the synthesis of the polymer.

The imaged photographic elements protected in accordance with this invention are derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such as paper prints. Because of the amount of handling that can occur with paper prints and motion picture prints, they are the preferred imaged photographic elements for use in this invention.

The photographic elements in which the images to b protected are formed can have the structures and components shown in Research Disclosures 37038 and 38957 and as disclosed in U.S. Ser. No. 09/299,395, filed Apr. 26, 1999 and U.S. Ser. No. 09/299,548, filed Apr. 26, 1999, incorporated by reference herein. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, and magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as color filter layers, interlayers, overcoat layers, subbing layers, and the like. All of these can be coated on a support which can be transparent (for example, a film support) or reflective (for example, a paper support). Photographic elements protected in accordance with the present invention may also include a magnetic recording material as described in *Research Disclosure,* Item 34390, November 1992, or a transparent magnetic recording layer such as a layer containing magnetic particles on the underside of a transparent support as described in U.S. Pat Nos. 4,279,945 and 4,302,523.

The present invention is illustrated by the following examples.

A two station gravure machine was used to coat the desired discontinuous coating on a photographic element. The photographic element used to demonstrate the current invention was a tricolor multilayered element, containing light sensitive silver halide layers coated on a reflective paper support. The details of the structure of the photographic element are given in copending application U.S. Ser. No. 09/341,968.

The face width of the engraved gravure cylinder and impression cylinder corresponded with the width of the web at 14". The gravure cylinder was made of a stainless steel base with a copper plating and had a diameter of 10". Nine different patch geometries were engraved on these cylinders. The engravings were made electromechanically by using a diamond tip engraving tool or stylus. The engraving tool is characterized by the stylus angle, which is the angle made by the apex of the diamond and controls the ratio of the width to the depth of the cell. The engraving geometry is defined by the shape of each cell and the spacing between cells. The compression angle defines the ratio of the vertical repeat length to the horizontal repeat length. Different geometries were engraved by varying the stylus angle, the compression angle and cell width as well as the spatial frequency of the cells. By varying the aforementioned factors, different patterned geometries were achieved, each having the desired average fluid hold up in the cells. It was assumed, based on knowledge in the art of gravure coating, that approximately half the volume of fluid is transferred from the cells on to the web, while the amount transferred may actually vary somewhat with the compression ratio of the pattern. Table 1 shows the various engraving parameters that were used to obtain the variations in the pattern geometries. For requirements of the current invention, the functional variations in the pattern geometries were 1) ratio of the cell area to the wall area (the wall area refers to the area that will remain uncoated on the photographic element). 2) cell width and 3) the distance between adjacent cells or the wall width. FIG. 6 shows the schematic of the engraving patterns drawn to scale. The copper plated stainless steel cylinder was engraved with the desired pattern and then chrome plated.

TABLE 1

| Pattern | | a | b | c | d | e | f | g | h | i |
|---|---|---|---|---|---|---|---|---|---|---|
| stylus angle | | 110 | 110 | 110 | 110 | 120 | 130 | 140 | 140 | 160 |
| compression angle | | 45 | 45 | 60 | 45 | 45 | 45 | 50 | 40 | 60 |
| cell width | μm | 100 | 115 | 100 | 58 | 222 | 213 | 200 | 200 | 375 |
| wall width | μm | 22.0 | 46.3 | 22.0 | 24.1 | 273.7 | 155.5 | 53.6 | 53.6 | 57.0 |
| wall/cell area | | 0.488 | 0.968 | 0.361 | 1.002 | 3.986 | 1.994 | 0.542 | 0.695 | 0.247 |
| % cell area | | 0.672 | 0.508 | 0.735 | 0.499 | 0.201 | 0.334 | 0.649 | 0.590 | 0.802 |
| vertical repeat, V | μm | 122.0 | 161.3 | 211.3 | 82.1 | 495.6 | 368.5 | 302.2 | 212.8 | 748.2 |
| horizontal repeat, X | μm | 122.0 | 161.3 | 122.0 | 82.1 | 495.7 | 368.5 | 253.6 | 253.6 | 432.0 |
| vertical screen, VS | lpi | 294.5 | 222.7 | 170.0 | 437.7 | 72.5 | 97.5 | 118.8 | 168.8 | 48.0 |
| horizontal screen, HS | lpi | 294.5 | 222.7 | 294.5 | 437.7 | 72.5 | 97.5 | 141.6 | 141.6 | 83.1 |
| actual screen | lpi | 294.5 | 222.7 | 223.8 | 437.7 | 72.5 | 97.5 | 129.7 | 154.6 | 63.2 |
| cell depth, d | μm | 35.01 | 40.26 | 35.01 | 20.31 | 64.09 | 49.67 | 36.40 | 36.40 | 33.07 |
| cell length, v | μm | 99.99 | 114.9 | 189.2 | 58.00 | 221.9 | 212.9 | 248.6 | 159.1 | 691.2 |
| engraved volume | cc/sqft | 1 | 1 | 1 | 0.5 | 1 | 1 | 1 | 1 | 1 |
| Estimated delivered volume | cc/sqft | 0.5 | 0.5 | 0.5 | 0.25 | 0.5 | 0.5 | 0.5 | 0.5 | 0.5 |

The coating process utilized a typical direct gravure setup, which comprised of (i) a simple pan feed, filled up to the required level for filling the cells, (ii) a standard clamped doctor blade holder using an 8 mil thick blade at a 35 degree application and an attack angle of 55 deg. to the tangent at the point of application, (iii) and a 70 durometer (hardness) backer roller. The dryer temperature was set to 180 deg F.

The polymer used to demonstrate this invention was an acrylic polymer dispersion NEOCRYL A-5090 from Zeneca Resins. The polymer has a minimum film forming temperature of 6° C. A second polymer used was a urethane/acrylic copolymer NEOCRYL R-9699. The coating solution of both polymers consisted of 40 parts by weight of the polymer latex suspension. As part of the variations, the solutions were used with and without various thickening agents added. The thickening agents used were KELTROL T (Xanthan gum) and poly vinyl pyrrolidone K90 from BASF. All solutions had 0.1% of OLIN 10 G surfactant added as a coating aid to reduce surface tension.

The rheological characteristics of the various coating solutions were measured using a HAAKE rheometer and measured at room temperature. The following polymer solutions were used to coat:

Solution A: 40% A5090 NEOCRYL A-5090+0.1% OLIN 10 G

Solution B: 40% NEOCRYL A-5090+0.1% OLIN 10 G+0.25% KELTROL T

Solution C: 40% NEOCRYL R-9699+0.06% KELTROL T+0.45% K90

The rheological profiles of the coating solutions are plotted in FIG. 6. The coating conditions and the results are shown in Table 2.

TABLE 2

| Example # | Coating Solution | Coating Speed ft/min | Coating Quality |
|---|---|---|---|
| 1 | A | 20–300 | no patterns formed, all ribbed |
| 2 | B | 20 | patterns a–i formed |
| 3 | B | 300 | patterns a,e,f,i formed |
| 4 | C | 20 | pattern a,b,c,f,g,i formed |

Figure 8:
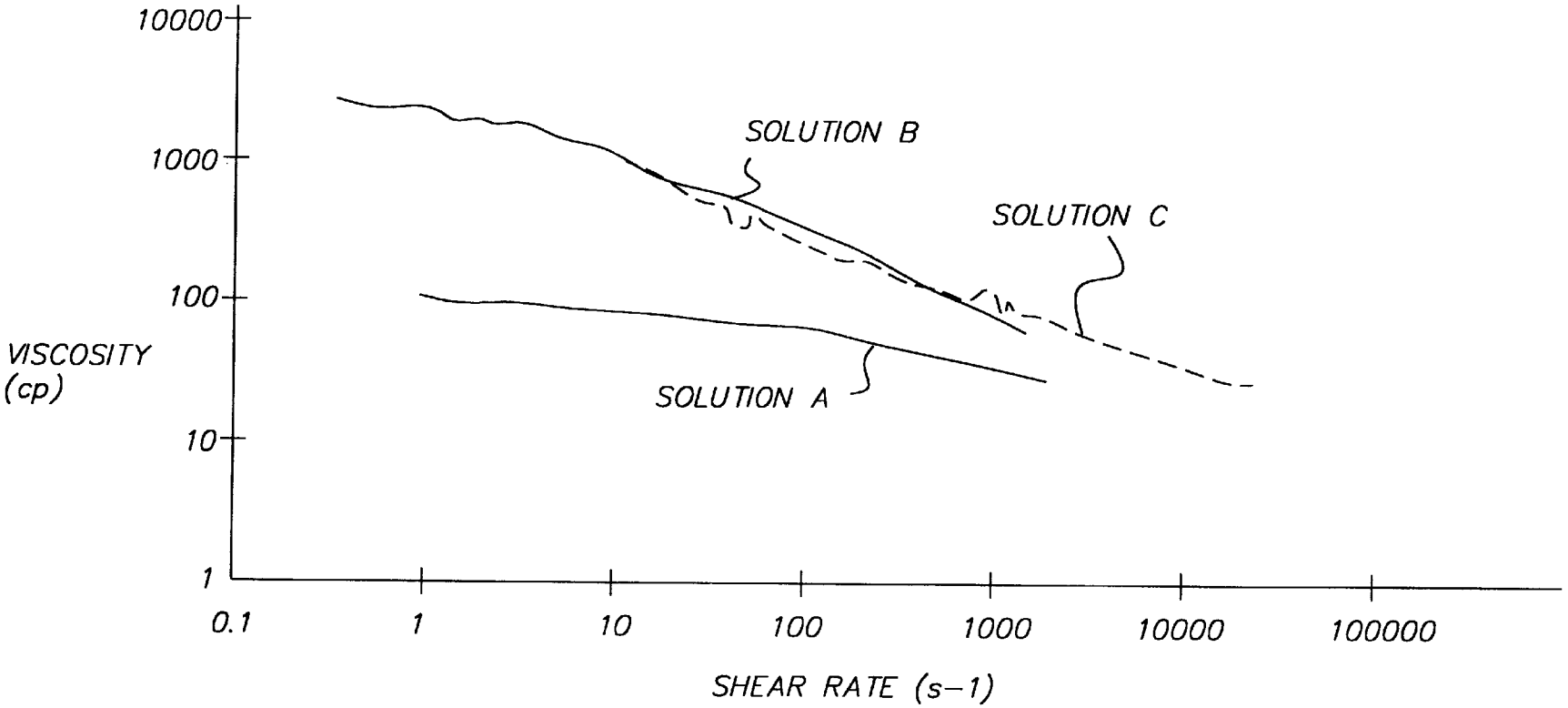
FIG. 8 shows the viscosity versus shear rate for polymeric solutions used in the Examples.

The photomicrographs of the actual coated patterns for Example 2 are shown in FIG. 7. The viscosity versus shear rate for the coating solutions is shown in FIG. 8.

The above table shows that by varying the coating speed and the rheology of the coating solutions it is possible to form a discontinuous overcoat in a desired pattern that is engraved on the cylinder. Furthermore the desired rheology can be achieved by using a single thickening agent (as in example 2) or by using a combination of thickening agents (as in example 4).

A coating corresponding to the pattern shown in FIG. 5 was produced as follows. The face width of the engraved gravure cylinder and impression cylinder corresponded with the width of the web at 14". The gravure cylinder was made of a stainless steel base with a copper plating and had a diameter of 10". The gravure cylinder was engraved with a hardened steel triangular engraving tool. The engraving had 230 lines per inch engraved at 45° angle to the axis of the cylinder. Each line was 20 microns deep, 90 microns cell width (width of the stripe) on top and 19 microns land width (distance between stripes). The volume engraved was 0.71 cc/ft$^2$ of surface area. It was assumed, based on knowledge in the art of gravure coating, that approximately half the volume of fluid is transferred from the cells on to the web.

The polymer used to demonstrate this invention was an acrylic polymer dispersion NEOCRYL A-5090 from Zeneca Resins. It has an acid number of 11. Dibutyl phthalate was added to the latex, as a polymer plasticizer. The dibutyl phthalate was added directly into the latex dispersion at a level of 20% by weight with respect to the polymer. The coating solution was composed of 40 parts by weight of the polymer latex suspension, 0.2 parts by weight of KELTROL T (xanthan gum), 0.5 parts by weight of poly vinyl pyrolidone (LUVISKOL K90, made by BASF), 0.1 parts by weight of OLIN 10 G surfactant and the rest was water.

The gravure coating machine was set up as follows: the blade load was set at 8 psi, and the backer pressure at 10 psi for the coating, while a dryer temperature of 180° F. was found to be adequate for drying all the patch variations The coating strips were processed in RA4 chemistry. The coating strips were then passed through a roller fuser at 128° C. and a pressure of 23 psi. Water resistance of the overcoat was measured using an aqueous solution Ponceau Red dye which is known to stain gelatin through ionic interaction. Ponceau Red dye solution was prepared by dissolving 1 gram dye in 1000 grams mixture of acetic acid and water (5 parts:95 parts). The water permeability was done by placing a drop of the dye solution on the sample for 10 minutes followed by a 30-second water rinse to remove excess dye solution on the coating surface. Each sample was then air dried, and status A reflectance density on the spotted area was recorded. An optical density of 3, such as for the uncoated imaging element, indicates a completely water permeable coating its water resistance=0%. Assuming an optical density of 3 (for the uncoated imaging element) for 0% water resistance and an optical density of 0 for 100% water resistance, the percent water resistance for a sample is calculated using the following equation.

$$\text{Percent water resistance}=100[1-(\text{status A density}/3)]$$

The water resistance of the uncoated imaging element was 0% while that of the striped overcoat after processing and fusing was 70% indicating enhanced fusability. The fused overcoat provided was continuous. When the overcoat pattern is a series of stripes of polymer it is more effective in making the polymer flow together to form a continuous overcoat.

The invention has been described in detail with particular reference to certain preferred embodiments thereof, but it will be understood that variations and modifications can be effected within the spirit and scope of the invention.

What is claimed is:

1. A method of providing an imaging element comprising:

providing a gravure cylinder having an outer surface having a plurality cells;

moving the surface of the cylinder through a coating solution of a film forming organic polymer, either a water dispersible or water soluble polymer, to thereby fill the cells with coating solution;

moving an imaging element across the outer surface of the gravure cylinder thereby depositing the coating solution onto the imaging element such that a fraction of the surface area of the imaging element of from 0.02 to 0.98 remains uncovered with coating solution, wherein a distance between any point in a covered area and the nearest edge of an uncovered area is not greater than 100 $\mu$m and the longest distance between any point in an uncovered area and the nearest edge of a covered area is not greater than 500 $\mu$m, and drying the coating solution to form a discontinuous overcoat on the imaging element, such that the film forming organic polymer is capable of fusing to form a continuous water impermeable protective layer in the presence of heat and/or pressure.

2. The method of claim 7 where the viscosity of the coating solution is greater than 1000 cp when measured at 1 $s^{-1}$.

3. The method of claim 4 where the viscosity of the coating solution is greater than 1000 cp when measured at 1 $s^{-1}$.

4. The method of claim 1 wherein the mean polymer laydown of the organic polymer is 0.11 $g/m^2$ to 5.38 $g/m^2$ over the entire surface of the imaging element and the film forming organic polymer is selected from the group consisting of polymers of alkyl esters of acrylic or methacrylic acid, the hydroxyalkyl esters of the same acids, the nitriles and amides of the same acids, vinyl acetate, vinyl propionate, vinylidene chloride vinyl chloride, vinyl aromatic compounds, dialkyl maleates, dialkyl itaconates dialkyl methylene-malonates, isoprene, butadiene, chlorinated propylene, ethyl cellulose, nitrocellulose, linseed oil-modified alkyd resins, rosin-modified alkyd resins, phenol-modified alkyd resins, phenolic resins, polyesters, poly (vinyl butyral), polyisocyanate resins, polyurethanes, polyamides, chroman resins, dammar gum, ketone resins, maleic acid resins, poly(tetrafluoroethylene-hexafluoropropylene), low-molecular weight polyethylene, phenol-modified pentaerythritol esters, copolymers with siloxanes and polyalkenes, copolymers thereof and combinations thereof.

5. The method of claim 1 wherein a distance between any point in a cell to a nearest edge of the cell is less than 200 $\mu$m and a minimum distance between adjacent cells is 40 $\mu$m.

6. The method of claim 1 wherein the mean polymer laydown of the organic polymer is 0.11 $g/m^2$ to 5.38 $g/m^2$ over the entire surface of the imaging element and the film forming organic polymer is selected from the group consisting of polymers of alkyl esters of acrylic or methacrylic acid, the hydroxyaljyl esters of the same acids, the nitriles and amides of the same acids, vinyl acetate, vinyl propionate, vinylidene chloride, vinyl chloride, vinyl aromatic compounds, dialkyl maleates, dialkyl itaconates, dialkyl methylene-malonates, isoprene, butadiene, chlorinated propylene, ethyl cellulose, nitrocellulose, linseed oil-modified alkyd resins, rosin-modified alkyd resins, phenol-modified alkyd resins, phenolic resins, polyesters, poly (vinyl butyral), polyisocyanate resins, polyurethanes, polyamides, chroman resins, dammar gum, ketone resins, maleic acid resins, poly(tetrafluoroethylene-hexafluoropropylene), low-molecular weight polyethylene, phenol-modified pentaerythritol esters, copolymers with siloxanes and polyalkenes, copolymers thereof and combinations thereof.

7. A method of providing an imaging element comprising:

providing a gravure cylinder having an outer surface having a plurality cells;

moving the surface of the cylinder through a coating solution of a film forming organic polymer to thereby fill the cells with coating solution, wherein the coating solution comprises a viscosity greater than 200 cp measured at a shear rate of 1 $s^{-1}$ and a viscosity greater than 50 cp measured at a shear rate of 1000 $s^{-1}$;

moving an imaging element, by means a direct gravure coating operation, across the outer surface of the gravure cylinder, thereby depositing the coating solution onto the imaging element, such that a fraction of the surface area of the imaging element of from 0.02 to 0.98 remains uncovered with coating solution, wherein a distance between any point in a covered area and the nearest edge of an uncovered area is not greater than 100 $\mu$m and the longest distance between any point in an uncovered area and the neares edge of a covered area is not greater than 500 $\mu$m; and drying the coating solution to form a discontinous overcoat on the imaging element;

whereby the discontinous polymer coating has a geometry that is the same as the engraving on the cylinder.

8. A method of providing an imaging element comprising:

providing a gravure cylinder having an outer surface having a plurality cells;

moving the surface of the cylinder through a coating solution of a film forming organic polymer to thereby fill the cells with coating solution;

moving an imaging element across the outer surface of the gravure cylinder, thereby depositing the coating solution onto the imaging element such that a fraction of the surface area of the imaging element of from 0.02 to 0.98 remains uncovered with coating solution, wherein the longest distance between any point in an uncovered area and the nearest edge of a covered area is not greater than 500 $\mu$m and wherein a distance between any point in a cell to a nearest edge of the cell is less than 500 $\mu$m; and drying the coating solution to form a discontinous overcoat on the imaging element;

wherein the overcoat forms a pattern of either discrete islands of coated organic polymer or discrete islands uncoated by organic polymer.

* * * * *